US009187850B1

(12) United States Patent
Sheffer

(10) Patent No.: US 9,187,850 B1
(45) Date of Patent: Nov. 17, 2015

(54) POM-POM

(75) Inventor: Kathleen M. Sheffer, Seven Valleys, PA (US)

(73) Assignee: FLUFF MONKEY ENTERPRISES, LLC, Seven Valleys, PA (US)

( * ) Notice: Subject to any disclaimer, the term of this patent is extended or adjusted under 35 U.S.C. 154(b) by 61 days.

(21) Appl. No.: 13/165,953

(22) Filed: Jun. 22, 2011

(51) Int. Cl.
*A47L 17/08* (2006.01)
*D04D 7/06* (2006.01)

(52) U.S. Cl.
CPC .. *D04D 7/06* (2013.01); *A47L 17/08* (2013.01)

(58) Field of Classification Search
CPC ..... A41D 23/00; A41D 27/08; A41D 27/20; A41D 15/04; D04D 7/08; D04D 7/10
USPC ..... 428/40.1, 4, 5
See application file for complete search history.

(56) References Cited

U.S. PATENT DOCUMENTS

| | | | | | |
|---|---|---|---|---|---|
| 1,897,778 | A | * | 2/1933 | Wallace | 15/229.11 |
| 2,290,216 | A | * | 7/1942 | Steinmetz et al. | 15/244.1 |
| 2,849,821 | A | * | 9/1958 | Doig | 428/5 |
| 3,283,339 | A | | 11/1966 | Heifetz | |
| 3,336,618 | A | * | 8/1967 | Day | 15/229.11 |
| 3,924,288 | A | * | 12/1975 | Breland | 15/225 |
| 4,199,835 | A | * | 4/1980 | Heyer et al. | 15/229.11 |
| 4,515,837 | A | * | 5/1985 | Cheng | 428/4 |
| D364,716 | S | * | 11/1995 | Lazar | D32/40 |
| 5,679,416 | A | * | 10/1997 | Cheng | 428/5 |
| 6,280,356 | B1 | | 8/2001 | Sandeen | |
| 6,443,527 | B1 | * | 9/2002 | Borcherds et al. | 300/21 |
| 7,014,080 | B2 | * | 3/2006 | Cheng | 223/46 |
| 2005/0000050 | A1 | * | 1/2005 | Galvin et al. | 15/226 |
| 2010/0000008 | A1 | * | 1/2010 | Lewis | 2/207 |

OTHER PUBLICATIONS

Fleecy Clean Small Ball, produced by Kyjen, available at its webpage, http://www.kyjen.com/shop/index.php/catalog/product/view/id/616/s/fleecy-clean-ball-small/category/248/ dated Jun. 22, 2011. Photo attached.

* cited by examiner

*Primary Examiner* — Donald Tarazano
*Assistant Examiner* — Stephanie Cox
(74) *Attorney, Agent, or Firm* — Barnes & Thornburg LLP

(57) ABSTRACT

A pom-pom has a plurality of flexible sheets with each sheet including fingers on opposite edges, two side-by-side strips between the fingers, a plurality of spaced links joining the strips and openings or slits between the links. A tie tightly surrounds the links to form the pom-pom.

21 Claims, 6 Drawing Sheets

POM-POM

BACKGROUND OF THE INVENTION

Conventional pom-poms are made from stacks of fabric sheets having opposed rows of fingers with the sheets gathered and held together by a circumferential tie. The tie is tightened and the fingers extend outwardly from the tie to form a spherical body of radially extending fingers.

The tie forms a pom-pom with a large core occupying the center of the pom-pom, corresponding short fingers and a less compressible body. The sheets are not held in place in the core and, with use, can be pulled from the pom-pom. Removal of sheets from the pom-pom reduces the usefulness of the pom-pom and loosens other sheets for removal. Retightening of a tie to compensate for removal of a sheet is difficult or impossible.

Accordingly, there is a need for an improved pom-pom with a small core and correspondingly longer fingers and a soft body for a given diameter.

Additionally, there is need for a pom-pom which may be used for dusting, washing and polishing with long fingers and the ability to retain material in the fingers and dispense the material during use.

The sheets should be held in the pom-pom to prevent removal.

BRIEF DESCRIPTION OF THE INVENTION

The invention is an improved pom-pom and improved method for manufacturing a pom-pom. The pom-pom is made from flexible sheets held together by a tie and has a small, tight core smaller than the core in a conventional pom-pom, long fingers and a soft body which is easier to grip and use. The fingers extending outward from the pom-pom core may have curls which can be used to retain soap or polish when the pom-pom is used as a washing or polishing tool. During use, the soap or polish is dispensed from the curls to facilitate washing or polishing.

The sheets forming the pom-pom are locked in the tie when the tie is tightened to form the pom-pom. The tie holds the sheets in the pom-pom during use.

DESCRIPTION OF THE PREFERRED EMBODIMENTS

Figure 1:
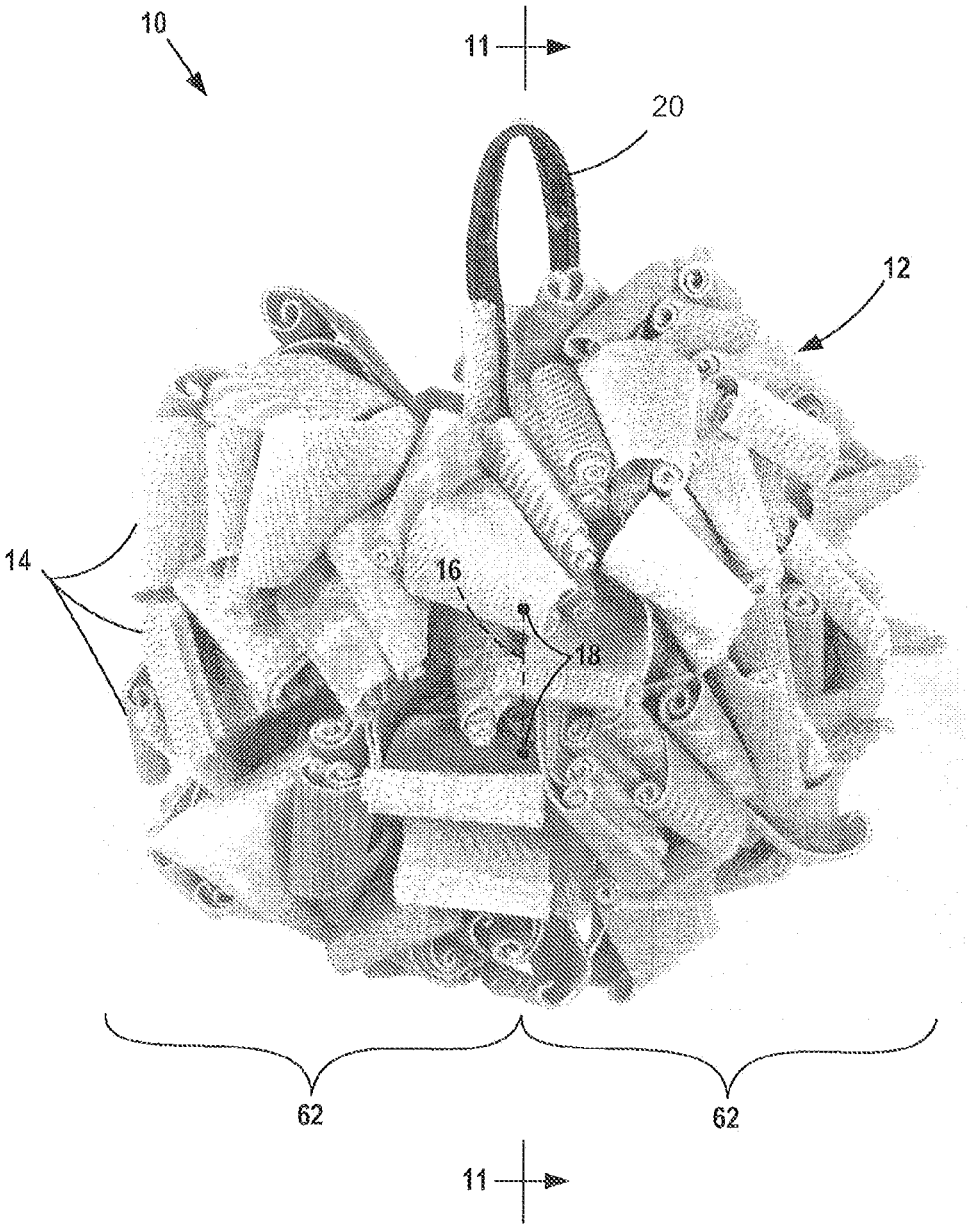
FIGS. 1 and 2 are side views of a pom-pom taken at 90° to each other.

Pom-pom 10 includes a generally spherical soft and compressible body 12 made up of a number of flexible sheets 22 having fingers 14 extending outwardly from a tightly gathered core 16. The sheet material in core 16 is gathered in a tightening tie 18, which may be a conventional tie used for bundling wiring.

Fingers 14 extend in all directions from tie 18 and gathered core 16 at the center of the body. Optional loop handle 20 is attached to tie 18 to facilitate holding the pom-pom, attaching the pom-pom on a carrier or placing the pom-pom on a support.

Figure 3:
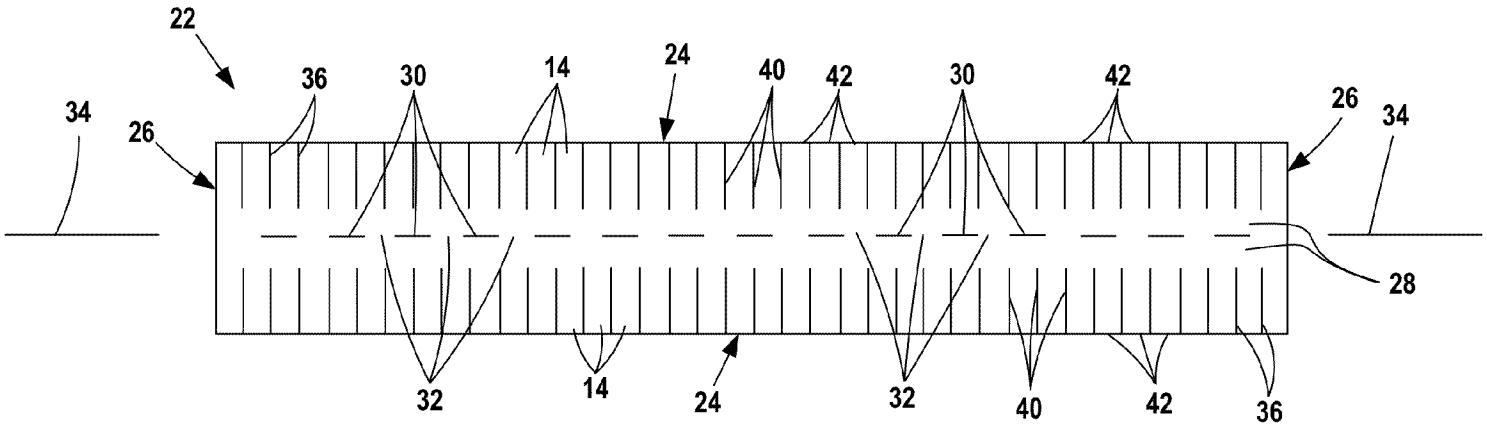
FIG. 3 is a top view of a fabric sheet used to form the pom-pom.

The pom-pom 10 includes a number of rectangular flexible sheets 22. Sheets 22 may be formed from fabric including spandex fibers. Each sheet 22 has opposed side edges 24 and opposed ends 26. Two side-by-side and straight strips 28 extend along the length of the sheet from end to end. The strips are located centrally between side edges 24, as illustrated in FIG. 3. Strips 28 are separated by a line of spaced slits 30 which extend between sheet ends 26. The strips 28 are joined together by links 32 located between adjacent slits 30. The slits 30 and links 32 lie on straight line 34 extending parallel to side edges 24 and equidistant between the side edges 24. If desired, slits 30 may be replaced by cut openings on line 34 between links 32. The openings have spaced apart edges. For instance, the openings in the flat sheets 22 may be lens-shaped with spaced edges extending distances to either side of line 34 when the sheet is flat and not foreshortened.

A plurality of regularly spaced side slits 36 extend from the outer edge of each strip 28 to the adjacent side edge 24 of sheet 22. Slits 36 form a row of spaced, parallel fabric fingers 14 extending outwardly from each strip 28 to the adjacent side edge 24. The fingers 14 have finger edges 40 and finger ends 42. The edges 40 are formed by slits 36 and, in the case of the fingers at either end of the sheet, by sheet ends 26.

Figure 4:
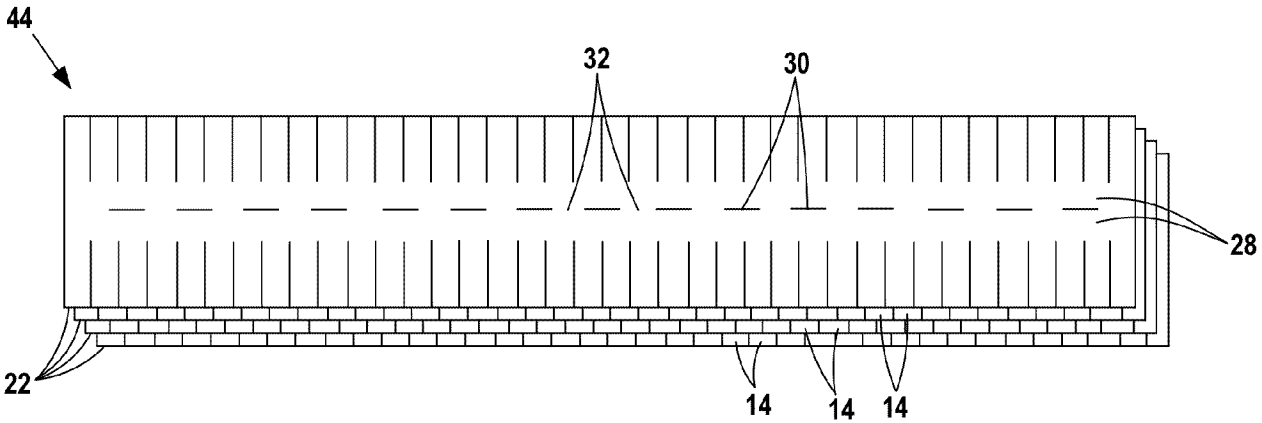
FIG. 4 is a perspective view of a stack of fabric sheets shown in FIG. 2.

Pom-pom 10 includes a number of sheets 22. The pom-pom is made by placing sheets 22 on top of each other to form a sheet stack 44 shown in FIG. 4. The individual sheets 22 are positioned in the stack with the lines 34 for each sheet aligned and over or under the lines 34 for the other sheets in the stack. The slits or openings 30 and links 32 in each sheet are on aligned lines 34. The individual slits or openings and links need not be vertically aligned. Strips 28 are vertically aligned. The fingers in the strips are vertically stacked but need not be aligned. The sheets preferably have the same width and length so that the stack has vertical side walls and ends. Fingers 14 preferably have the same length and width, but may have different lengths and widths.

Next, stack 44 is placed on a support surface 46 and the opposing ends 26 of the sheets in the stack are moved toward each other to shorten the length of the stack and form a number of waves or folds 48 in the stack extending across the sheets.

Figure 6:
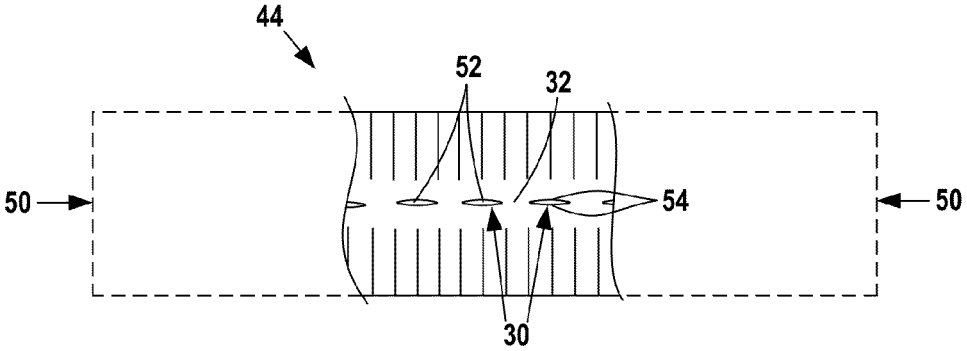
FIG. 6 is a top view of FIG. 5, partially gathered and partially broken away.

FIG. 6 is a top view of the stack during initial end-to-end foreshortening and illustrates that foreshortening of the stack in response to forces 50 shortens the lengths of slits 30 and spreads the slit edges 54 apart from each other to form openings 52 extending through the sheets at the slits. The openings and links are on lines 34.

Figure 7:
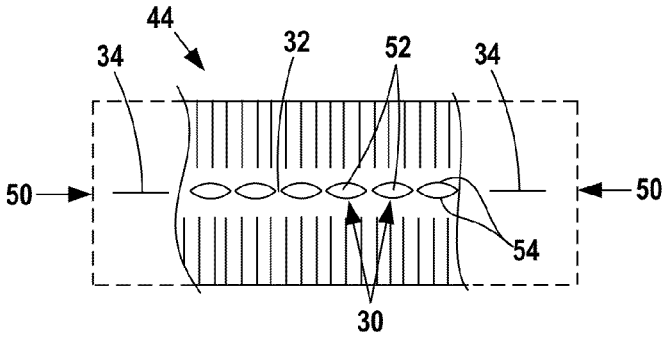
FIG. 7 is a top view of the stack of sheets further gathered than in FIG. 6.

FIG. 7 is like FIG. 6 and shows stack 44 after further foreshortening by forces 50. Slits 30 have been opened to form enlarged openings 52 with slit sides 54 in each sheet 22 located to either side of center line 34 for the sheet.

Figure 8:
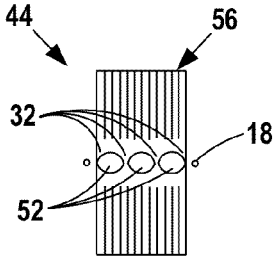
FIG. 8 is a top view of the sheets fully gathered into a bundle with a loose tie surrounding the center of the bundle.

The length of the sheet stack 44 is reduced until ends 26 are close to each other and the sheets between the ends are grouped together in bundle 56 shown in FIG. 8. The strips 28 in bundle 56 are folded together. The height and width of the bundle are approximately the same. The rows of fingers 14 are folded in the bundle.

Figure 5:
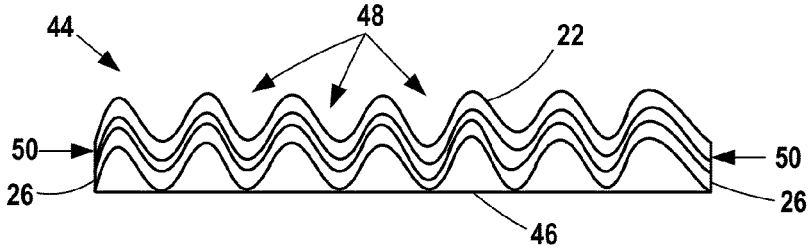
FIG. 5 is a generalized side view of the stacked sheets during gathering to form a bundle.

As shown in FIGS. 5 and 6, spandex fabric is typically flaccid and has little internal rigidity. This property facilitates forming bundle 56. FIG. 5 illustrates waves 48 diagrammatically. The waves in flexible spandex sheets may not bow above surface 46. Pom-pom 10 may be made from sheets of material having greater stiffness than spandex fabric.

After forming bundle 56, with enlarged openings 52 at the slits, circular tie 18, with handle 20 attached, is extended around one end of the bundle and moved to the center of the bundle so that the plane of the tie overlies the enlarged openings 52. With tie 18 surrounding the bundle 56 as shown in FIG. 8, the tie is tightened to compress links 32 at the center of the bundle and form the pom-pom.

Tightening of the tie reduces the diameter of the tie so that the tie tightens around links 32 and captures the fabric links 32 at the core of the bundle. The links 32 are compressed together and are held tightly in the tightened tie. The links 32 in all sheets 22 are surrounded and captured by the tie. The slit sides 54 and strips 28 for all the sheets are bowed to opposite sides of the tie to reduce material captured by the tie and reduce the size of the core. The strips 28 adjacent the slits or openings extend outwardly from the tie and are not captured by the tie. The strips 28 form circumferential retention members 60 that are larger than the tie, extend around the tie and help hold the sheets in the tie.

The tie is tightened to hold all of the links in place in the plane of the tie. The links are compressed together by the tie. The links may be captured flat in the tie or may be folded or bent in the tie. The shape of the links when held together in the tie is not critical.

When the tie 18, which is on the outside of the sheets, is fully tightened, the fingers 14 extend from the tie in all directions to form two finger hemispheres 63 forming spherical body 12. Each hemisphere 62 extends to one side of the tie 18. The fingers 14 extend outwardly from the tie and are spread apart to fill the hemispheres 62 and form spherical body 12. The fingers close to the plane of the tie overlap each other so that the body 12 has a uniform appearance without visual indication of the existence or orientation of the tie. The tie 18 preferably has a clasp to reduce scraping contact with the surfaces washed or polished by the pom-pom.

Pom-poms 10 may have different diameters, different finger density and different style fabric fingers. For example, for a four-inch diameter pom-pom, sheets 22 may have a four-inch width and a 30-inch length with 40 fingers spaced along each strip side edge. Strips 28 may have a width of one-half inch. The slits 30 may be one inch long with the links 32 between slits one-half inch long. A four-inch pom-pom may have four sheets and 320 fingers 14, 160 fingers in each hemisphere 62.

A five-inch diameter pom-pom may use strips similar to the strips for the four-inch pom-pom but having a five-inch width with two-inch long fingers. Correspondingly, six- and seven-inch diameter pom-poms would use strips similar to the strips for the four-inch diameter pom-pom but having widths of six and seven inches, respectively, and correspondingly longer fingers.

Sheets 22 in the pom-pom may be made of different fabrics. Sheets may be made from stretchy fabric having 80% nylon and 20% spandex fibers. Alternatively, stretchy 80% nylon/20% spandex sheets may be mixed with slightly abrasive nylon mesh sheets in a single pom-pom. Preferably, the nylon mesh sheets are separated by nylon/spandex sheets. The nylon sheets have a gentle abrasive finish making the pom-pom suitable for bathing human skin or washing animals. Alternatively, sheets 22 may be formed from different materials including fabric with spandex, fabric without spandex, rubber, plastic, an elastomer, or a fibrous material such as paper.

Fabric formed from nylon and spandex fibers has different structural characteristics in the directions of the two different and perpendicular fibers. This means that the fingers 14 having the spandex fibers extending along the length of the fingers and the nylon fibers extending across the fingers have different stretch characteristics than fingers having the nylon fibers extending along the length of the fingers and the spandex fibers extending across the fingers.

Sheets 22 may be cut from bolts of spandex/nylon fabric to orient the fibers in the fingers as desired. The perpendicular orientation of the spandex and nylon fibers promotes the formation of curls on either the sides or the ends of the fingers. Curls in the finger edges or ends occur after a pom-pom with nylon/spandex fabric has been washed in heated water and dried. Heating of the fabric during washing, followed by drying, is believed to produce curls.

Figure 2:
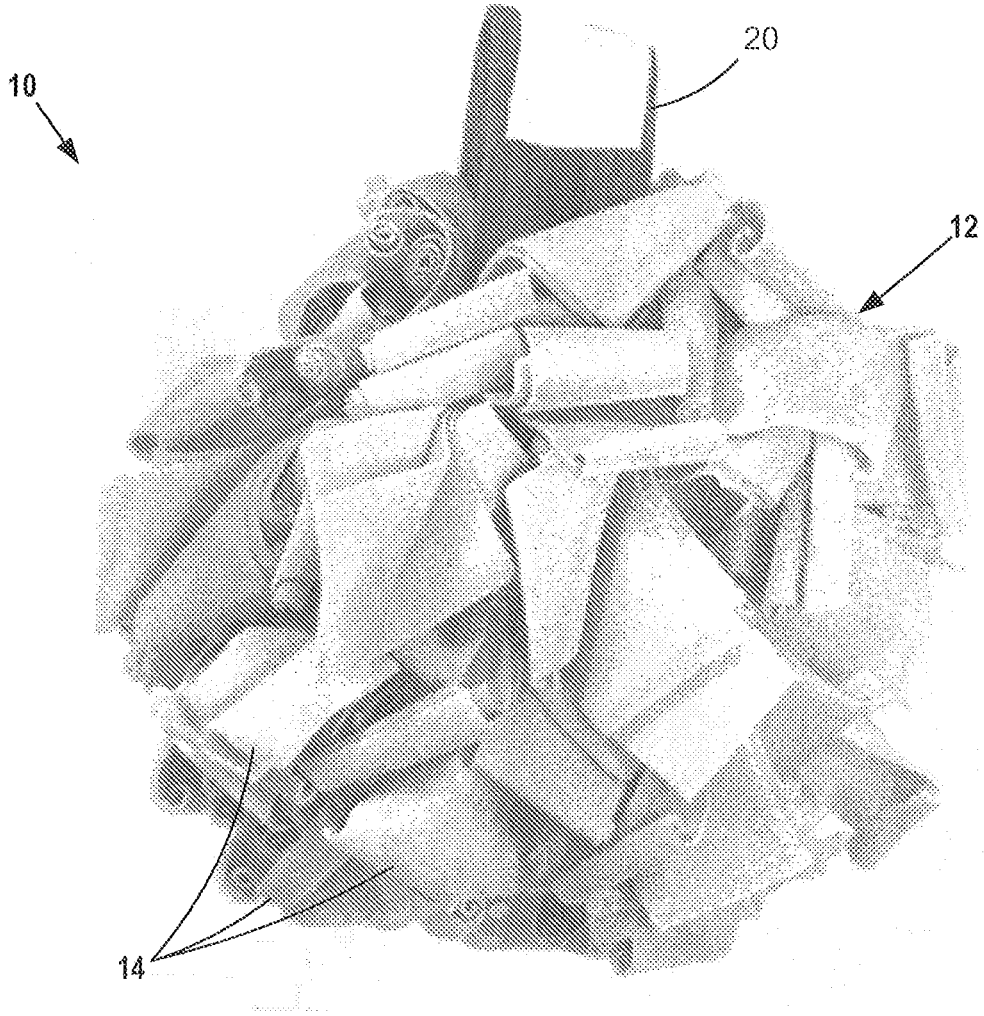
Figure 9:
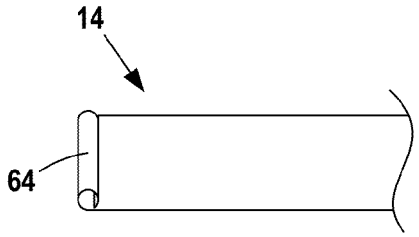
FIG. 9 is a perspective view of a fabric finger showing an end curl.
Figure 10:
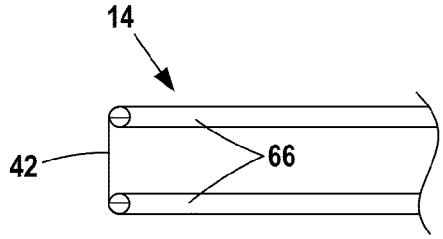
FIG. 10 is a perspective view of a fabric finger with edge curls.
Figure 11:
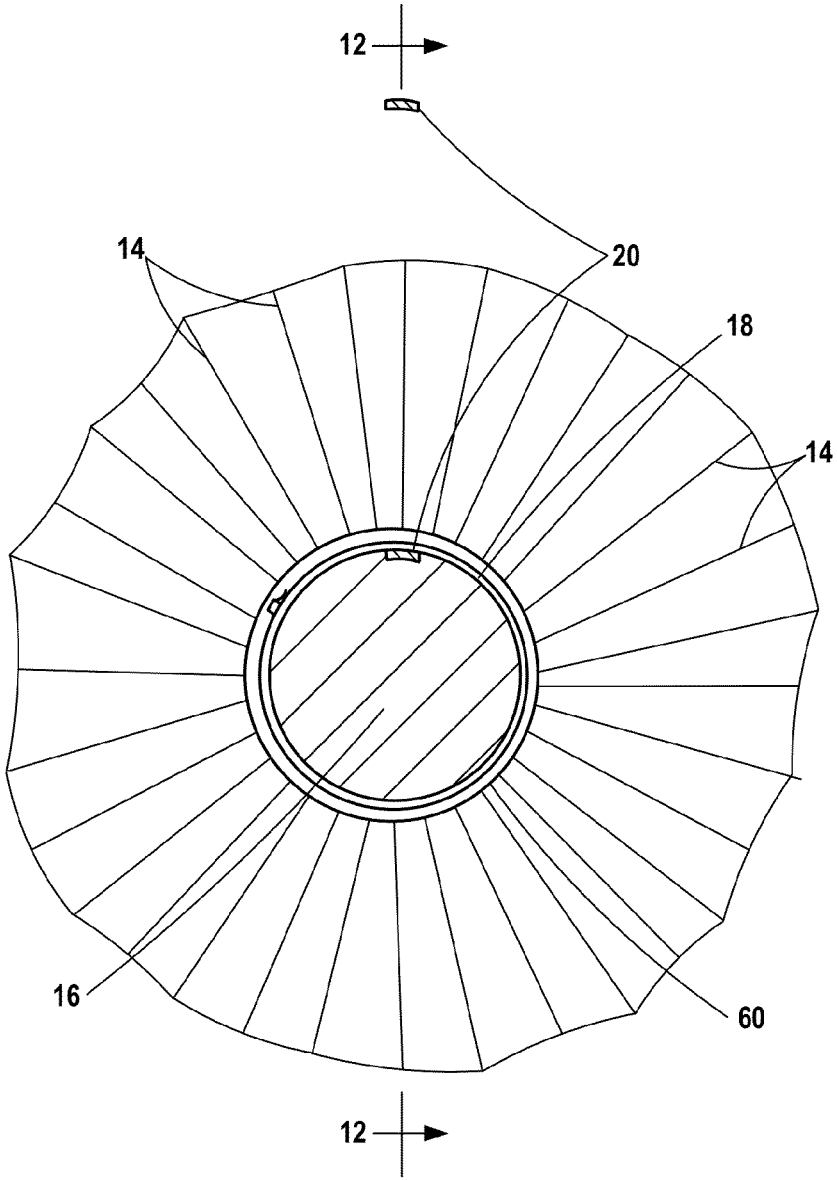
FIG. 11 is a sectional view taken along line 10-10 of FIG. 1.
Figure 12:
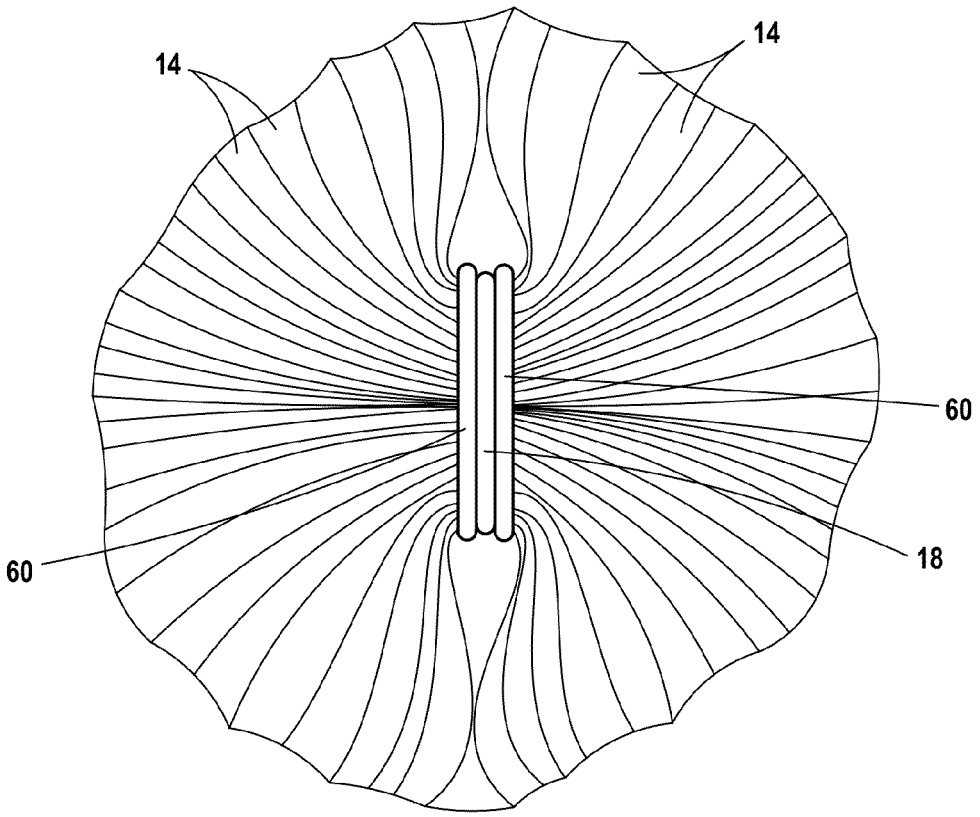
FIG. 12 is a sectional view taken along line 12-12 of FIG. 11.

FIG. 9 is a perspective view of a finger 14 with an end curl 64 at the finger end away from the tie. FIG. 10 is a perspective view of a finger with two edge curls 66 extending along the sides or edges of the finger from the adjacent strip 28 to finger end 42. The pom-pom illustrated in FIGS. 1 and 2 has fingers with ends curls. When pom-pom 10 is used as a washing tool, a quantity of soap can be captured inside the curls and is gradually dispensed for use during washing. When the pom-pom is used as a polishing or waxing tool, a quantity of polish or wax can be captured in the curls and dispensed from the curls during use.

The pom-pom may be used for waxing furniture or waxing automobile paint. The pom-pom may be used as a duster. The pom-pom may also be also used as a children's or pet's toy, a cheerleading device or as a decorative piece worn on clothing or otherwise displayed.

What I claim is my invention:

1. A pom-pom of the type having a core and a plurality of fingers extending outwardly in all directions from the core, the pom-pom comprising a plurality of stretchy flexible sheets formed of different materials having different structural characteristics, each sheet having a plurality of fingers on opposite sheet edges, two side-by-side strips between the fingers, a plurality of spaced links joining the strips, the links on a line, and slits extending through the sheet spaced along the line between the links and adapted to form enlarged openings; and a circumferential tie at the pom-pom core, said tie being on the outside of the sheets and tightly surrounding all of the sheets and said links, the slits adjacent the tie extending to either side of the tie, the strips on each side of the tie gathered to form sheet retention bodies extending outwardly of the tie, wherein said sheet retention bodies hold the sheets in the tie.

2. The pom-pom as in claim 1 wherein all of said fingers have approximately the same length and said pom-pom is generally spherical.

3. The pom-pom as in claim 1 wherein at least one sheet is formed from one of the following materials and at least a second sheet is formed from a different one of the following materials: fabric with spandex, fabric without spandex, rubber, plastic, an elastomer, or a fibrous material.

4. The pom-pom as in claim 1 wherein said tie is circular.

5. The pom-pom as in claim 1 wherein said tie surrounds all said links and said links and retention bodies are in the pom-pom core, said fingers extending away from the core to finger ends at the exterior surface of the pom-pom.

6. The pom-pom as in claim 1 wherein at least some fingers include end curls.

7. The pom-pom as in claim 1 wherein at least some fingers include side curls.

8. The pom-pom as in claim 1 wherein each sheet includes side edges and slits extending inwardly from said side edges, said slits forming sides of said fingers.

9. The pom-pom as in claim 1 wherein the fingers on each side of the tie form generally semi-spherical bodies, the fingers in said bodies overlapping at the plane of the tie.

10. The pom-pom as in claim 1 including a handle attached to the tie and extending outwardly of said fingers.

11. The pom-pom as in claim 1 wherein said lines are straight when the sheets are flat.

12. The pom-pom as in claim 1 wherein each of said sheet retention bodies extend around the tie.

13. The pom-pom as in claim 1 wherein said tie includes a clasp.

14. A pom-pom comprising,

A. a plurality of sheets formed of different stretchy materials having different structural characteristics, each sheet having opposed generally parallel side edges and opposed ends, two strips located side-by-side inwardly of the sheet side edges and extending between the sheet ends, the strips separated by a line, a plurality of spaced slits extending through the sheet, the slits spaced along said line and adapted to form enlarged openings, a plurality of links on said line between said slits, said links connecting said strips together, and plurality of fabric fingers, each fabric finger joined to a strip and extended outwardly from the strip to an adjacent sheet side edge; and B. a circumferential tie, said circumferential tie being on the outside of the sheets and tightly surrounding said links and said slits such that the plane of the tie overlies all of said links and said enlarged openings, the slits adjacent the tie extending outwardly of the tie so that the strips at the tie hold the sheets in the pom-pom, and said fingers extending outwardly from the tie to form a pom-pom body.

15. The pom-pom as in claim 14 wherein at least one sheet is formed from one of the following materials: fabric with spandex, fabric without spandex, rubber, plastic, an elastomer, or a fibrous material.

16. The pom-pom as in claim 14 wherein said tie is circular.

17. The pom-pom as in claim 14 wherein at least some fingers include end curls.

18. The pom-pom as in claim 14 wherein at least some fingers include side curls.

19. The pom-pom as in claim 14 wherein said sheets are each formed from fabric and at least one sheet includes spandex fibers.

20. The pom-pom as in claim 14 wherein said fingers extend outwardly from both strips.

21. A method of making a pom-pom comprising providing a plurality of stretchy flexible sheets, at least two of the sheets being formed of different materials having different structural characteristics, each sheet having a plurality of fingers on opposite sheet edges, two side-by-side strips between the fingers, a plurality of spaced links joining the strips, the links on a line, and slits extending through the sheet spaced along the line between the links and adapted to form enlarged openings, positioning the plurality of sheets in a stack with the lines for each sheet aligned and over or under the line of each other sheet in the stack, placing the stack on a support surface and moving opposing ends of the sheets towards each other to shorten a length of the stack and to form folds in the stack extending across the sheets and to form openings at the slits, applying a force to the sheets so that the slits form enlarged openings, extending a tie so that it overlies the openings and surrounds the stack with the slits adjacent the tie extending outwardly of the tie so that the strips at the tie hold the sheets in the pom-pom, and tightening the tie to compress the links at the center of the bundle to form a pom-pom.

* * * * *